United States Patent [19]

Sapper

[11] Patent Number: 4,560,199

[45] Date of Patent: Dec. 24, 1985

[54] RECLINER CHAIR

[75] Inventor: Richard Sapper, Stuttgart, Fed. Rep. of Germany

[73] Assignee: Pamont AG, Basel, Switzerland

[21] Appl. No.: 587,939

[22] Filed: Mar. 9, 1984

[30] Foreign Application Priority Data

Jul. 22, 1983 [DE] Fed. Rep. of Germany ..... 3326433

[51] Int. Cl.[4] ..... A47C 1/032

[52] U.S. Cl. ..... 297/323; 297/301; 297/316; 297/320

[58] Field of Search ..... 297/323, 316, 320, 321, 297/340, 344, 325, 326, 300, 301, 302, 303

[56] References Cited

U.S. PATENT DOCUMENTS

| | | | |
|---|---|---|---|
| 332,237 | 12/1885 | Curtiss | 297/321 |
| 1,836,630 | 12/1931 | Thum | 297/326 |
| 2,615,496 | 10/1952 | Lorenz et al. | 297/300 |
| 3,741,607 | 6/1973 | Cramer | 297/302 |
| 4,380,352 | 4/1983 | Diffrient | 297/301 |

FOREIGN PATENT DOCUMENTS

| | | | |
|---|---|---|---|
| 2057980 | 6/1971 | Fed. Rep. of Germany | 297/325 |
| 2434104 | 2/1975 | Fed. Rep. of Germany | 297/325 |
| 345992 | 6/1960 | Switzerland | 297/300 |

*Primary Examiner*—William E. Lyddane
*Assistant Examiner*—Mark W. Binder
*Attorney, Agent, or Firm*—Michael J. Striker

[57] ABSTRACT

A chair includes a seat support, a seat formed of two portions one of which is rigidly connected to the seat support, and a back rest also formed of two portions one of which is connected to another portion of the seat. The two seat portions are pivotally connected to each other and the two back portion are also pivotally connected to each other. The pivotable portion of the seat together with the back can swing from the sitting position of the chair to the backward-leaning rest position by means of a quadrangular linkage having four arms pivotally connected to each other. Two adjacent arms of the linkage are pivoted with respect to the rigid portion of the seat, about a pivoting connection near the horizontal axis of the pivotable portion of the seat.

10 Claims, 1 Drawing Figure

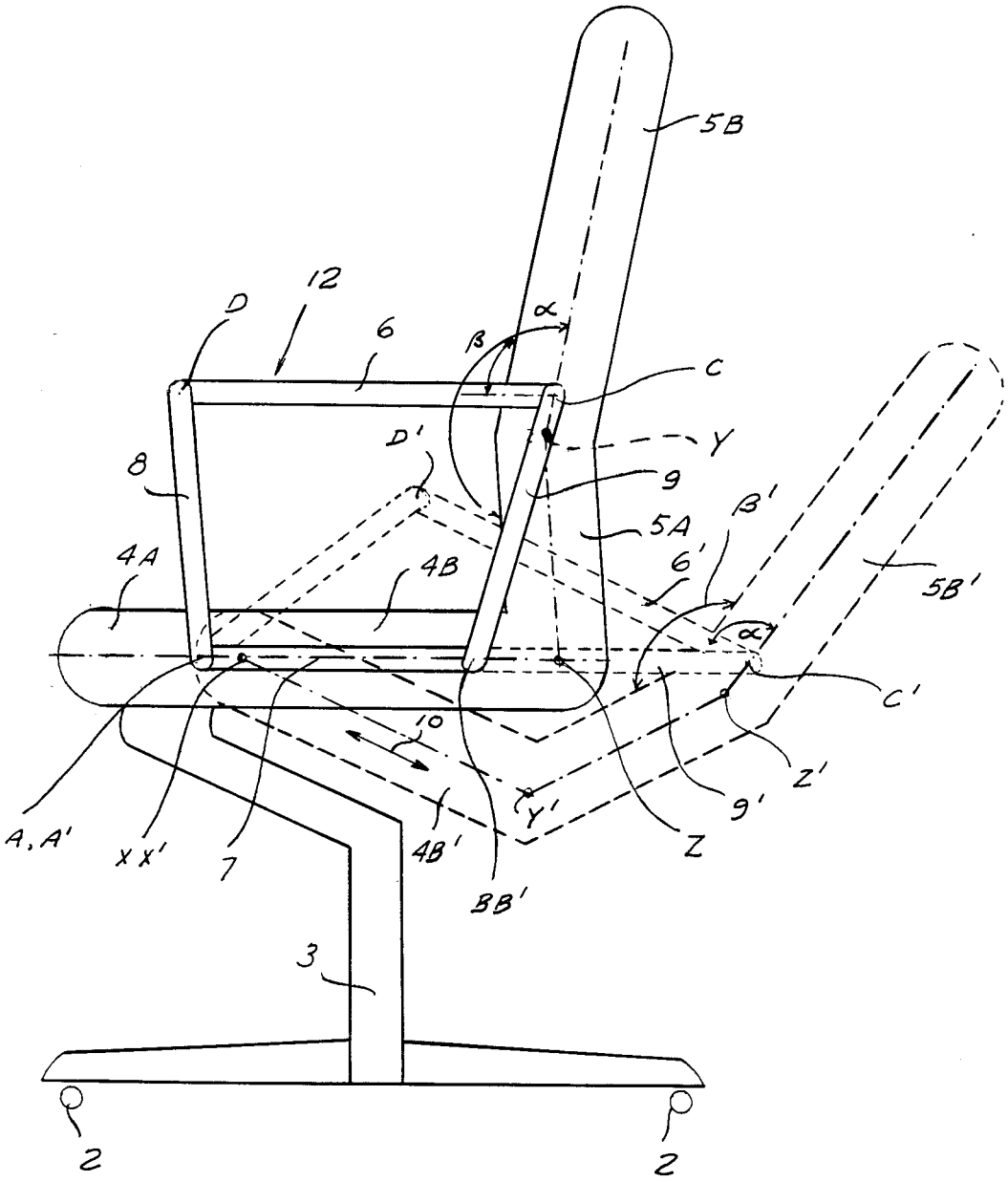
5B
12
D
6
β
α
C
Y
D'
9
8
5A
β'
4A
4B
6'
5B'
α
C'
10
Z'
9'
Y'
A, A'
XX'
7
4B'
Z
BB'
3
2
2

RECLINER CHAIR

BACKGROUND OF THE INVENTION

The present invention relates to a chair having a seat swingable from a normal sitting position to a backward-leaning rest position and back to the normal sitting position.

Chairs known in the art have multiple adjustment functions, such as an adjustment of the vertical position of the seat and adjustments of the seat and the back portions dependently and independently from each other.

However, known constructions of the chairs do not render possible an adjustment of a curve shape of the seat, for a seated person, from the upright seat supporting (lordose) to the back-leaning seat supporting (kyphose).

SUMMARY OF THE INVENTION

Assuming that it is desirable to adjust the chair to the shape of the spine of the seated person during the transition of the chair from the upright supporting position to the backward-leaning rest position, it is an object of the present invention to provide a chair in which a supporting point of the seat during the transition of the chair from one supporting position to another supporting position will be adjusted in a favorable fashion for a seated person.

These and other objects of the invention are attained by a chair, comprising a seat support; a seat portion connected to said seat support and a back portion connected to said seat portion, said seat portion with said back portion being swingable from a normal sitting position to a backward-leaning rest position and backwards from the backward-leaning rest position to the sitting position, said seat portion including a forward part rigidly connected to said seat support and a rear part pivotally connected to said forward part and adapted to pivot in a downward direction about a first horizontal pivot axis; said back portion including an upper part and a lower part pivotally connected to said upper part and adapted to pivot in respect thereto about a second horizontal pivot axis, said lower part being, together with said rear part of said seat portion, pivotable about said first horizontal axis; and at least one quadrangular linkage means interconnected between said upper part of the back portion and said seat portion, said linkage means including a first arm and a second arm which extend substantially horizontally when the chair is in said sitting position, said second arm being rigidly connected to said seat support, a forward third arm pivotally connected to said first arm at a first pivoting connection and pivotally connected to said second arm at a third pivoting connection and a rear fourth arm pivotally connected to said first arm at a second pivoting connection and pivotally connected to said second arm at a fourth pivoting connection; said first arm having a rear end rigidly connected to a lower end of said upper part of the back portion, said second arm having a forward end and said third arm having a lower end which are pivotally connected with respect to each other and to said forward part of the seat portion at said third pivoting connection near said first horizontal pivot axis, said second arm being a rigid carrier for said forward third arm and a pivot point for said rear fourth arm.

Due to the construction of the chair according to the invention, in which all the aforementioned components are combined and function simultaneously during the swinging of the chair from the upright sitting position to the backward-leaning rest position and vice versa, an anatomically correct movement course of a seated person during that swinging is effectively assisted.

In many cases it has been expedient to install in the chair one or more springs, which generate a force, against which the swinging motion of the seat, particularly during the first part of that motion, is performed.

According to a further concept of the invention the back portion has a forward side which has a convexly bent shape in said sitting position, which shape is changed, during the swinging of the chair from said sitting position to the backward-leaning rest position, and the angle between said upper part and said lower part of said back portion is changed so that the convexly is reduced.

According to still a further concept of the invention the back portion has a forward side which may have a convexly bent shape in said sitting position, which shape is transmitted, during the swinging of the chair from said sitting position to the backward-leaning rest position, through a straightly extended line to a concavely bent shape.

According to still a further feature of the invention an angle included between said upper part of said back portion and said lower part of said back portion in the sitting position of the chair may be at least 190°.

Furthermore, the angle included between said upper part of said back portion and said lower part of said back portion in said backward-leaning rest position may be at most 180°.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing schematically illustrates a side view of the chair according to the invention, in which the chair shown by solid line is in a sitting portion and the chair shown by broken line is in a backward-leaning rest position.

DETAILED DESCRIPTION OF THE PREFERRED EMBODIMENTS

Referring now to the drawing in detail, the chair according to the invention is comprised of a stand 3 having lower horizontally extended bars terminated with rollers 2 in the known fashion and a vertical part with a sloped end portion 3', to which a seat generally designated as 4 is connected. Seat 4 includes a forward portion 4A rigidly connected to end portion 3' of stand 3, and a rear portion 4B. A back rest 5 of the chair, comprised of an upper portion 5B and lower portion 5A, is connected to seat 4. The lower portion 5A of the back rest 5 can be pivotally connected to the rear portion 4B of the seat at a horizontal pivot axis denoted by reference character Z.

Two pivoting quadrangular structures denoted by reference character 12 are positioned at two opposite sides of the chair. Each pivoting quadrangular structure 12 includes two opposite arms 6 and 7, which extend substantially parallel to each other and horizontally in the sitting position of the chair, a third arm 8, which is a forward arm as viewed in the direction of front portion 4A of the seat, and a rear arm 9. Forward arm 8 connects arms 6 and 7 to each other in the front region of the quadrangular structure 12 whereas rear arm 9 connects arms 6 and 7 to each other in the rear region of the structure. All the arms or links 6, 7, 8 and 9 are pivotally connected to each other by respective pivoting connections extending through horizontal axes A, B, C and D so that arms 6, 7, 8 and 9 can pivot about those horizontal axes, respectively. Arm 7 is rigidly connected to the stand 3. Each quadrangular structure 12 takes approximately the shape of a trapezoid when the chair is in the sitting position and takes some other quadrangular shapes when the chair is in the other pivotal positions.

The forward portion 4A of the seat 4 is rigidly connected as was mentioned above, to the stand 3. The rear portion 4B is pivotally connected to the forward portion 4A of the seat at a first horizontal pivot axis X; thereby rear portion 4B of the seat can pivot in the downward direction relative to forward portion 4A about axis X. The first arm or link 6 of the quadrangular structure 12 is rigidly and at a predetermined angle connected to the lower end of the upper portion 5B of the chair back 5 so that the angle denoted by $\alpha$ between the direction of elongation of arm 6 and the direction of elongation of upper portion 5B of the chair back remains unchanged in any position of the chair. Portions 5A and 5B of the back rest are pivotally connected to each other at a second horizontal pivot axis Y.

As seen in the drawings, the lower portion 5A of the back is pivotally connected at the third horizontal pivot axis Z to the rear portion 4B of the seat 4. In addition, the rear portion 4B can be displaced in the directions of arrows 10 relatively to portion 5A of the back. Such a connection can be obtained by any suitable conventional means.

If the chair is transmitted from the normal sitting position shown by solid line to the backward leaning rest position shown by broken line, the rear portion 4B of the seat is pivoted in the downward direction about axis X and is conveyed into the position 4B'. Inasmuch as rear portion 4B of the seat 4 is pivotally and displaceably, in the directions of arrows 10, connected to lower portion 5A of the back 5 the upper end of the lower portion 5A of the back will, upon the movement of the rear end of portion 4B of the seat in the downward direction, be also lowered and brought to the position 5A'.

Both arms 6 and 8, upon lowering of portions 4B and 5A to the positions 4B' and 5A', are pivoted or displaced to the positions 6' and 8' shown by broken lines. Since the upper portion 5B is angularly rigidly connected with arm 6 angle $\beta$ included between portions 5A and 5B of the chair back 5, will considerably change, for example in the range of about 60° in the course of lowering of the rear portion of the seat 4. Theconvex shape of the side of the back facing a user, will turn into a concave shape, upon lowering of the seat portion 4B together with the back into the backward-leaning rest position. A convexly bent zone (with the angle at the center of about 200°) in the region facing towards the loins of the user of the chair is transformed, during the lowering of the rear portion of the seat, from the slightly convex shape through the straight line into the strongly concave shape (with the angle at the center of about 140°).

Due to the structure of the chair according to the invention, an anatomically correct "rolling motion" of the user's spine during the transition of the chair from the normal sitting position to the backward-leaning rest position is achieved and an anatomically favorable course of movement of the spine, particularly in the regions of the loins of the user, during the backward pivoting movement from the rest position to the sitting position of the chair is obtained also.

It will be understood that each of the elements described above, or two or more together, may also find a useful application in other types of chairs differing from the types described above.

While the invention has been illustrated and described as embodied in a chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A chair, comprising a seat support; a seat portion connected to said seat support; a back portion connected to said seat portion, said seat portion with said back portion being swingable from a normal sitting position to a backward-leaning rest position and backwards from the backward-leaning rest position to the sitting position, said seat portion including a forward part rigidly connected to said seat support and a rear part pivotally connected to said forward part and adapted to pivot in a downward direction about a first horizontal pivot axis; said back portion including an upper part and a lower part pivotally connected to said upper part and adapted to pivot in respect thereto about a second horizontal pivot axis, said lower part pivotally connected with said rear part of said seat portion and together pivotable about said first horizontal axis; and at least one quadrangular linkage means interconnected between said upper part of the back portion and said seat portion, said linkage means including a first arm and a second arm which extend substantially horizontally when the chair is in said sitting position, said second arm being rigidly connected to said seat support, a forward third arm pivotally connected to said first arm at a first pivoting connection and pivotally connected to said second arm at a third pivoting connection, and a rear fourth arm pivotally connected to said first arm at a second pivoting connection and pivotally connected to said second arm at a fourth pivoting connection; said first arm having a rear end rigidly connected to a lower end of said upper part of the back portion, said second arm having a forward end and said third arm having a lower end which are pivotally connected with respect to each other and to said forward part of the seat portion at said third pivoting connection near said first horizontal pivot axis, said second arm being a rigid carrier for said forward third arm and a pivot point for said rear fourth arm.

2. The chair as defined in claim 1, wherein said first horizontal pivot axis of the rear part of said seat portion and said third pivoting connection between the forward end of said second arm and the lower end of said third arm of said linkage means are in alignment.

3. The chair as defined in claim 1, wherein two said linkage means are provided, each linkage means being positioned at one respective side of the seat portion.

4. The chair as defined in claim 1, wherein said back portion has a forward side which has a convexly bent shape in said sitting position, which shape is changed, during the swinging of the chair from said sitting position to the backward-leaning rest position, and the angle ($\beta$) between said upper part and said lower part of said back portion is changed so that the convexity is reduced.

5. The chair as defined in claim 1, wherein said back portion has a forward side which has a convexly bent shape in said sitting position, which shape is transmitted, during the swinging of the chair from said sitting position to the backward-leaning rest position, through a straightly extended line to a concavely bent shape.

6. The chair as defined in claim 4, wherein said angle ($\beta$), included between said upper part of said back portion and said lower part of said back portion in the sitting position of the chair is at least 190°.

7. The chair as defined in claim 4, wherein said angle ($\beta$) is about 200°.

8. The chair as defined in claim 4, wherein an angle ($\beta'$) included between said upper part of said back portion and said lower part of said back portion in said backward-leaning rest position is at most 180°.

9. The chair as defined in claim 5, wherein said angle ($\beta'$) is about 140°.

10. The chair as defined in claim 1, further comprising at least one spring, said spring being arranged and dimensioned in such a fashion that at least a first part of the swinging of the rear part of the seat portion in a rearward direction is performed against a force of said spring.

* * * * *